US010182647B2

(12) United States Patent
Gunjian

(10) Patent No.: US 10,182,647 B2
(45) **Date of Patent: *Jan. 22, 2019**

(54) TWISTED WIRE BRUSH AND METHOD OF MAKING

(71) Applicant: Brushtech, Inc., Plattsburgh, NY (US)

(72) Inventor: Zaven Gunjian, Plattsburgh, NY (US)

(73) Assignee: Brushtech, Inc., Plattsburgh, NY (US)

( * ) Notice: Subject to any disclaimer, the term of this patent is extended or adjusted under 35 U.S.C. 154(b) by 502 days.

This patent is subject to a terminal disclaimer.

(21) Appl. No.: 14/809,363

(22) Filed: Jul. 27, 2015

(65) Prior Publication Data

US 2015/0327659 A1 Nov. 19, 2015

Related U.S. Application Data

(63) Continuation of application No. 13/792,787, filed on Mar. 11, 2013, now Pat. No. 9,101,205.

(51) Int. Cl.

| | |
|---|---|
| ***A46D 3/00*** | (2006.01) |
| ***A46B 3/18*** | (2006.01) |
| ***A46D 1/00*** | (2006.01) |

(52) U.S. Cl.

CPC ..... *A46D 1/0207* (2013.01); *A46B 3/18* (2013.01); *A46D 3/00* (2013.01)

(58) Field of Classification Search

CPC ..... A46D 3/00; A46D 1/00; A47J 37/0786

See application file for complete search history.

(56) References Cited

U.S. PATENT DOCUMENTS

| | | | |
|---|---|---|---|
| D90,523 | S | 5/1869 | Goodfellow |
| 181,532 | A | 8/1876 | Melbert |
| 559,905 | A | 5/1896 | Pike |
| 761,702 | A | 6/1904 | Paradis |
| 1,296,719 | A | 3/1919 | Veeck M |
| 1,515,503 | A | 11/1924 | Lucey |
| 1,576,182 | A | 3/1926 | Fletcher |
| 1,588,940 | A | 6/1926 | Cave |
| 1,711,741 | A | 5/1929 | Nelson |
| 1,762,182 | A | 6/1930 | Mayer |
| 1,910,153 | A | 5/1933 | Eisenhut et al. |

(Continued)

FOREIGN PATENT DOCUMENTS

| | | | |
|---|---|---|---|
| JP | 2006-262984 | A | 10/2006 |

OTHER PUBLICATIONS

Canadian Office Action, Canadian Application No. 2,820,703, dated Jan. 16, 2017 (5 pages).

*Primary Examiner* — Michael Jennings

(74) *Attorney, Agent, or Firm* — Burr & Brown, PLLC

(57) ABSTRACT

A twisted wire brush comprises a wire core and at least one length of spring coil. The wire core has a first length, defines a core axis, and comprises at least two core wires intertwined. The core wires twist helically about the core axis. Each length of spring coil extends about at least one of the core wires, and each length of spring coil is pressed between the twisted core wires. In another embodiment, a method of making a twisted wire brush comprises providing at least two core wires, positioning a length of spring coil about each core wire, aligning each length of spring coil, and twisting each core wire about a core axis. In yet another embodiment, a grill brush comprises a handle, a plurality of twisted core wires attached to the handle, and at least one length of spring coil, each length extending about at least one core wire.

14 Claims, 3 Drawing Sheets

(56) References Cited

U.S. PATENT DOCUMENTS

| | | | |
|---|---|---|---|
| 1,935,128 | A | 11/1933 | Pullman |
| D98,940 | S | 3/1936 | Hertzberg |
| 2,186,832 | A | 1/1940 | Hertzberg |
| 2,223,783 | A | 12/1940 | Fletcher |
| 2,279,209 | A | 4/1942 | Snyder |
| 2,528,514 | A | 11/1950 | Harvey et al. |
| D173,852 | S | 1/1955 | Pope |
| 2,792,579 | A | 5/1957 | Roy |
| 2,835,392 | A | 5/1958 | Hamilton |
| 2,897,525 | A | 8/1959 | Goodwin et al. |
| 2,913,756 | A | 11/1959 | MacFarland |
| 3,112,263 | A | 11/1963 | Ellilä |
| 3,337,892 | A | 8/1967 | Speyer |
| 4,056,863 | A | 11/1977 | Gunjian |
| 4,114,221 | A | 9/1978 | Enchelmaier |
| 4,135,574 | A | 1/1979 | Treplin et al. |
| 4,192,036 | A | 3/1980 | Heymann |
| 4,350,202 | A | 9/1982 | Schulz et al. |
| 4,357,727 | A | 11/1982 | McDowell |
| 4,389,926 | A | 6/1983 | Joyner |
| 4,395,943 | A | 8/1983 | Bandli |
| 4,429,811 | A | 2/1984 | Bakeman |
| 4,473,217 | A | 9/1984 | Hashimoto |
| 4,567,917 | A | 2/1986 | Millard |
| D285,487 | S | 9/1986 | Tjernagel |
| 4,667,690 | A | 5/1987 | Hartnig |
| 4,733,425 | A | 3/1988 | Hartel et al. |
| 4,782,843 | A | 11/1988 | Lapaglia |
| 4,819,291 | A | 4/1989 | Gunjian |
| 4,850,071 | A | 7/1989 | Lawrence |
| 4,927,281 | A | 5/1990 | Gueret |
| 4,941,227 | A | 7/1990 | Sussman |
| D310,123 | S | 8/1990 | Carlson |
| 5,010,950 | A | 4/1991 | Voith |
| 5,067,195 | A | 11/1991 | Sussman |
| 5,168,593 | A | 12/1992 | Poje et al. |
| 5,253,386 | A | 10/1993 | LaLonde |
| 5,319,823 | A | 6/1994 | Baum et al. |
| 5,339,480 | A | 8/1994 | Murg et al. |
| 5,370,141 | A | 12/1994 | Gueret |
| 5,452,490 | A | 9/1995 | Brundula et al. |
| 5,513,410 | A | 5/1996 | Liu |
| 5,515,892 | A | 5/1996 | Najafi et al. |
| 5,560,069 | A | 10/1996 | Berger et al. |
| 5,595,198 | A | 1/1997 | Kemmerer |
| 5,611,361 | A | 3/1997 | Leone |
| D380,090 | S | 6/1997 | Zemel |
| 5,778,476 | A | 7/1998 | Squillaci et al. |
| 5,819,354 | A | 10/1998 | Alonso et al. |
| 5,836,326 | A | 11/1998 | Inkster |
| 5,855,219 | A | 1/1999 | Spencer |
| 5,860,432 | A | 1/1999 | Gueret |
| 5,894,847 | A | 4/1999 | Gueret |
| 5,970,989 | A | 10/1999 | Litton |
| 5,970,990 | A | 10/1999 | Dunton et al. |
| D417,324 | S | 11/1999 | Farls |
| 6,035,907 | A | 3/2000 | DeCoster |
| 6,047,432 | A | 4/2000 | Sode |
| D425,668 | S | 5/2000 | Garofano et al. |
| 6,207,113 | B1 | 3/2001 | Kagaya |
| 6,237,609 | B1 | 5/2001 | Vasas |
| 6,241,411 | B1 | 6/2001 | Brieva et al. |
| 6,260,558 | B1 | 7/2001 | Neuner |
| 6,276,023 | B1 | 8/2001 | Grundy |
| 6,279,583 | B1 | 8/2001 | Neuner |
| 6,295,994 | B1 | 10/2001 | Thayer et al. |
| 6,390,708 | B1 | 5/2002 | Gueret |
| 6,427,700 | B1 | 8/2002 | Leone et al. |
| 6,470,897 | B1 | 10/2002 | Jung et al. |
| 6,574,823 | B1 | 6/2003 | Stegens |
| 6,823,552 | B1 | 11/2004 | Hillenbrand |
| 6,948,780 | B1 | 9/2005 | Litman et al. |
| 6,957,654 | B2 | 10/2005 | Montoli et al. |
| 7,089,946 | B2 | 8/2006 | Rousselet |
| 7,913,701 | B2 | 3/2011 | Dieudonat |
| 8,099,811 | B2 | 1/2012 | Gladney et al. |
| 8,607,398 | B2 | 12/2013 | Zahoransky et al. |
| 2002/0000016 | A1 | 1/2002 | Hsieh |
| 2003/0056809 | A1 | 3/2003 | Horton |
| 2003/0060824 | A1 | 3/2003 | Viart et al. |
| 2003/0172485 | A1 | 9/2003 | Dumler et al. |
| 2005/0060825 | A1 | 3/2005 | Hillenbrand |
| 2005/0133056 | A1 | 6/2005 | Montoli |
| 2005/0172437 | A1 | 8/2005 | Wachter |
| 2008/0047086 | A1 | 2/2008 | Gunjian |
| 2008/0138138 | A1 | 6/2008 | Gueret |
| 2009/0088278 | A1 | 4/2009 | Sasabe et al. |
| 2009/0276973 | A1 | 11/2009 | Bouix et al. |
| 2010/0192320 | A1 | 8/2010 | Borsari et al. |
| 2012/0082503 | A1 | 4/2012 | Gueret |
| 2012/0198639 | A1 | 8/2012 | Smith |

TWISTED WIRE BRUSH AND METHOD OF MAKING

CROSS REFERENCE TO RELATED APPLICATION

This application is a continuation of U.S. application Ser. No. 13/792,787, filed Mar. 11, 2013, the entirety of which is incorporated herein by reference.

FIELD OF THE INVENTION

The present invention relates to a twisted wire brush, and in particular, to a twisted wire cleaning brush for cleaning a grill.

BACKGROUND OF THE INVENTION

A twisted wire brush typically comprises bristles held by and extending radially from a twisted wire core. To form the twisted wire brush, the bristles are inserted between parallel wires while the wires are twisted to press the bristles between the wires.

Depending on the application for which a twisted wire brush might be intended, the density of the bristles and the surface area over which the bristles cover can be varied by adjusting the number of bristles, by angling the bristles at multiple angles from the core axis, and by bending the twisted wire core into various shapes. The bristles can also be made of varying materials having varying physical dimensions, flexibility, and other characteristics suitable for the particular application.

In twisted wire brushes built for cleaning applications, in which the brushes are used with relatively strong force to clean, the bristles can be relatively thick in diameter, made of metal, and be relatively rigid. However, despite the relative strength offered by the characteristics of many cleaning brushes, the bristles wear with use, often bending, splintering, and breaking during use. These brushes exhibit limited durability as a result, and can require regular replacement with regular use.

Further, in many instances, worn and damaged brushes can pose a nuisance or a hazard. With grill brushes, for example, a bristle fragment can attach to a grill on which food is cooked, and then find its way into the food that is ingested. The food-borne bristle can be a mere nuisance, or it can wind up causing internal harm to a person that chews and/or swallows the bristle fragment.

It would be desirable to provide a twisted wire brush that can overcome the disadvantages discussed above.

It would be desirable to provide a twisted wire brush that has greater durability, and/or is less prone to bristles breaking, splintering, or fragmenting.

SUMMARY OF THE INVENTION

To achieve these objects, embodiments of, and methods of making, a twisted wire brush are provided. In one embodiment, a twisted wire brush comprises a wire core and at least one length of spring coil. The wire core has a first length, defines a core axis, and comprises at least two core wires intertwined. The at least two core wires twist helically about the core axis. Each length of spring coil extends about at least one of the core wires, and each length of spring coil is pressed between the twisted core wires.

In some aspects of this embodiment, each length of spring coil comprises multiple spring coil segments.

In some aspects of this embodiment, each length of spring coil comprises a single spring coil.

In some aspects of this embodiment, a first length of spring coil extending about a first core wire defines a first spring coil diameter, a second length of spring coil extending about a second core wire defines a second spring coil diameter, and the first spring coil diameter is different than the second spring coil diameter.

In some aspects of this embodiment, a first length of spring coil extending about a first core wire and a second length of spring coil extending about a second core wire have the same spring coil diameter.

In some aspects of this embodiment, at least one of the lengths of spring coil has a diameter that varies.

In some aspects of this embodiment, each spring coil comprises a plurality of consecutive 360 degree turns about a coil axis, and at least a portion of each consecutive 360 degree turn abuts in an axial direction at least a portion of an immediately preceding consecutive 360 degree turn.

In another embodiment, a method of making a twisted wire brush comprises providing at least two core wires, positioning a length of spring coil about each core wire so that each core wire extends through the respective length of spring coil, aligning each length of spring coil positioned about one of the core wires adjacent to another length of spring coil positioned about another of the core wires, and twisting each core wire about a core axis to form a helix, to intertwine the core wires, and to press the lengths of spring coil between adjacent core wires. Each length of spring coil has a first and second end. Each length of spring coil is positioned so that each first end of each length of spring coil is aligned and each second end of each spring coil is aligned.

In some aspects of this embodiment, the method further comprises twisting each core wire until a predetermined value of torque on the core wires is reached.

In some aspects of this embodiment, each length of spring coil comprises multiple consecutive spring coils.

In some aspects of this embodiment, each length of spring coil comprises a single spring coil.

In some aspects of this embodiment, a first length of spring coil defines a first spring coil diameter, a second length of spring coil defines a second spring coil diameter, and the first spring coil diameter is different than the second spring coil diameter.

In some aspects of this embodiment, a first length of spring coil and a second length of spring coil each define a single spring coil diameter.

In some aspects of this embodiment, wherein at least one of the lengths of spring coil has a diameter that varies.

In some aspects of this embodiment, each spring coil comprises a plurality of consecutive 360 degree turns about a coil axis, and at least a portion of each consecutive 360 degree turn abuts in an axial direction at least a portion of an immediately preceding consecutive 360 degree turn.

In yet another embodiment, a twisted wire grill brush comprises a handle, a plurality of twisted core wires attached to the handle, and at least one length of spring coil, each length of spring coil extending superimposed about at least one core wire, each length of spring coil being pressed between the twisted core wires. The plurality of core wires is intertwined and twisted about a core axis.

In some aspects of this embodiment, each length of spring coil comprises multiple consecutive spring coils.

In some aspects of this embodiment, each length of spring coil comprises a single spring coil.

In some aspects of this embodiment, a first length of spring coil extending about a first core wire defines a first spring coil diameter, a second length of spring coil extending about a second core wire defines a second spring coil diameter, and the first spring coil diameter is different than the second spring coil diameter.

In some aspects of this embodiment, a first length of spring coil extending about a first core wire and a second length of spring coil extending about a second core wire have the same spring coil diameter.

In some aspects of this embodiment, at least one of the lengths of spring coil has a diameter that varies.

In some aspects of this embodiment, each spring coil comprises a plurality of consecutive 360 degree turns about a coil axis, and at least a portion of each consecutive 360 degree turn abuts in an axial direction at least a portion of an immediately preceding consecutive 360 degree turn.

In some aspects of this embodiment, an axial cross section of the twisted wire grill brush defines peaks and valleys across the twisted grill brush in an axial direction, and the spacing between each valley matches the spacing between wires in a wire grill.

These and other features and advantages of the present invention will be better understood from the following detailed description taken in conjunction with the accompanying drawings.

BRIEF DESCRIPTION OF THE DRAWINGS

For a fuller understanding of the nature and objects of the invention, reference should be made to the following detailed description of a preferred mode of practicing the invention, read in connection with the accompanying drawings, in which.

DETAILED DESCRIPTION OF THE INVENTION

Figure 1:
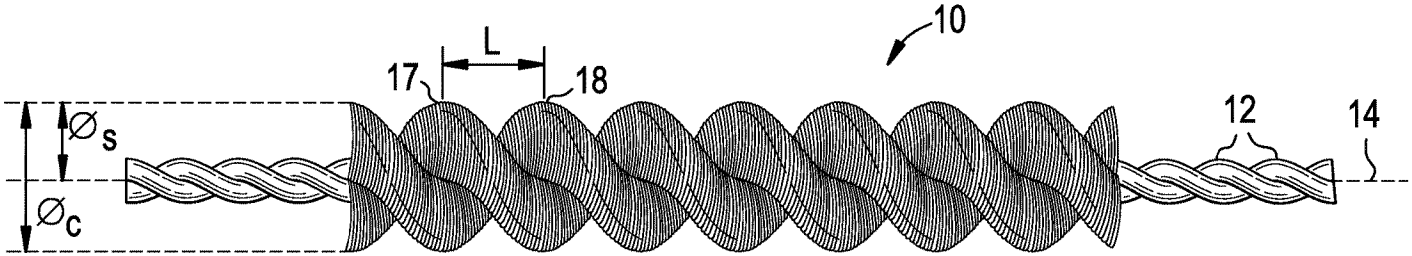
FIG. 1 illustrates a twisted wire brush, in accordance with one embodiment.

FIG. 1 illustrates a twisted wire brush 10, in accordance with one embodiment. The twisted wire brush 10 comprises a twisted wire core formed by core wires 12 intertwined (e.g., twisted about each other) and twisted helically about a core axis 14. The core wires 12 are intertwined so that each core wire 12 abuts an adjacent core wire 12 directly or with one or more spring coil wires pressed between. The twisted wire brush 10 also comprises at least one length of spring coil 16 extending about at least one core wire 12 and/or extending about each core wire 12, each length of spring coil 16 pressed between the twisted core wires 12.

The core wires 12 can be strong enough to resist deformation in the twisted state under predetermined pressures that might normally or reasonably be applied during cleaning, but be deformable in the pre-twisted state under a greater, specified pressure that can be applied during formation of the twisted wire core and the twisted wire brush 10. To be suitable, exemplary core wires 12 can be made of a variety of materials, such as, but not limited to galvanized steel, stainless steel, brass, other metallic materials, plastic, or other materials with similar structural characteristics. Suitable core wires 12 can range in diameter. For example, in some embodiments of a grill brush used for cleaning a cooking grill, the diameter of the core wires 12 can range from about 0.02 inches to about 0.3 inches, though the diameter of other embodiments of a grill brush can be outside this range. Depending on the material, the desired application, and other factors, diameters of core wires 12 can lie significantly outside this range. The core wires 12 illustrated in FIG. 1 have a diameter of about 0.135 inches.

Each spring coil 16 is also selected and/or designed, and incorporated into the twisted wire brush to provide relative strength and durability. Suitable spring coils 16 are fashioned from coil wire that can be made from a variety of materials, such as, but not limited to galvanized steel, stainless steel, brass, other metallic materials, plastic, or the like. In the exemplary embodiment depicted in FIG. 1, the spring coils 16 are made of galvanized music wire.

As with the core wires 12, the coil wire can range significantly in diameter. In one embodiment of a grill brush used for cleaning a cooking grill, the coil wire diameter ranges from about 0.01 inches to about 0.10 inches, though suitable diameters in other embodiments of a grill brush can be outside this range. Also, depending on the material, the desired application, and other factors, diameters of the coil wire can be significantly outside this range. Along with the variation in the coil wire diameter, the number of coils per inch of spring coil length, when a spring coil 16 is compressed axially so the coils all touch, can also vary. In the exemplary embodiment depicted in FIG. 1, the coil wire has a diameter of about 0.02 inches and each spring coil 16 has about 50 coils per inch of spring length with the spring compressed axially.

In the twisted wire brush 10, each length of spring coil 16 can be compressed axially so that at least a portion of each consecutive 360 degree turn around a coil axis, within a single spring coil 16, barring any aberrations in the uniformity of the spring coil 16, abuts in an axial direction an immediately preceding consecutive 360 degree turn. An aberration might be, or be caused by, one or more unintentional kinks (e.g., atypical or nonuniform bends) in the spring, a nonuniform manufacturing defect, a nonuniformity in the spring coil material, or another undesirable nonuniformity of the spring coil 16 that prevents any particular 360 degree turn from abutting an immediately preceding consecutive 360 degree turn. In some embodiments, barring aberrations, each 180 degree section of a turn abuts in an axial direction an immediately preceding consecutive 360 degree turn. In some embodiments, barring aberrations, each 90 degree section of a turn abuts in an axial direction an immediately preceding consecutive 360 degree turn. In some embodiments, barring aberrations, each 45 degree section of a turn abuts in an axial direction an immediately preceding consecutive 360 degree turn. In some embodiments, again barring any aberrations in the spring coil 16, the spring coil 16 can be compressed axially so that a majority of sections, or all sections, of each consecutive 360 degree turn abuts in an axial direction each immediately preceding consecutive 360 degree turn.

In some embodiments, all sections of each consecutive 360 degree turn around a coil axis are within about 0.20 inches of each immediately preceding consecutive 360 degree turn. In some embodiments, all sections of each consecutive 360 degree turn around a coil axis are within about 0.15 inches of each immediately preceding consecutive 360 degree turn. In some embodiments, all sections of each consecutive 360 degree turn around a coil axis are within about 0.10 inches of each immediately preceding consecutive 360 degree turn. In some embodiments, all sections of each consecutive 360 degree turn around a coil axis are within about 0.05 inches of each immediately preceding consecutive 360 degree turn.

The axial compression adds strength to the twisted wire brush 10, reducing or preventing axial deformation or deflection of individual 360 degree turns in each spring coil 16 during use of the twisted wire brush 10. For example, when each consecutive 360 degree turn around a coil axis, barring any aberrations, abuts in an axial direction an immediately preceding consecutive 360 degree turn, then each 360 turn in each spring coil 16 can lie in a plane approximately perpendicular to the core axis 14 (e.g., perpendicular plus or minus the diameter of the coil wire, or any shift of one or more 360 turns away from perpendicular caused by manufacturing defect or by a force, the latter caused, e.g., by use, misuse, etc.), and the axial compression can resist any force acting to deflect any individual 360 turn of a spring coil 16 out of the approximately perpendicular plane.

The spring constant of the spring coils 16 can vary. A relatively strong spring constant can help each spring coil 16 retain its shape and the desired level of spacing between each 360 degree turn, which can promote a more rigid twisted wire brush 10. A relatively weak spring constant can facilitate flexibility in the spring coil 16, which can promote a less rigid twisted wire brush 10. In the exemplary embodiment depicted in FIG. 1, the spring constant of each spring coil 16 is about 0.006 pounds per square inch.

The diameter of suitable spring coils 16 used in the twisted wire brush 10 can range greatly. In some embodiments of a twisted wire grill brush, the diameter of the spring coils 16 can range from about 0.125 inches to about 2.0 inches, though again, depending on the material, the desired application, and other factors, diameters well outside this range can be suitable. In the exemplary embodiment depicted in FIG. 1, each spring coil 16 has a diameter of about 0.5 inches. Spring coils 16 with equal diameters will produce a uniform twisted spring coil diameter $Ø_c$ across the axial length of the twisted spring coils 16, and a relatively high number of contact points against a flat, planar surface.

Figure 2:
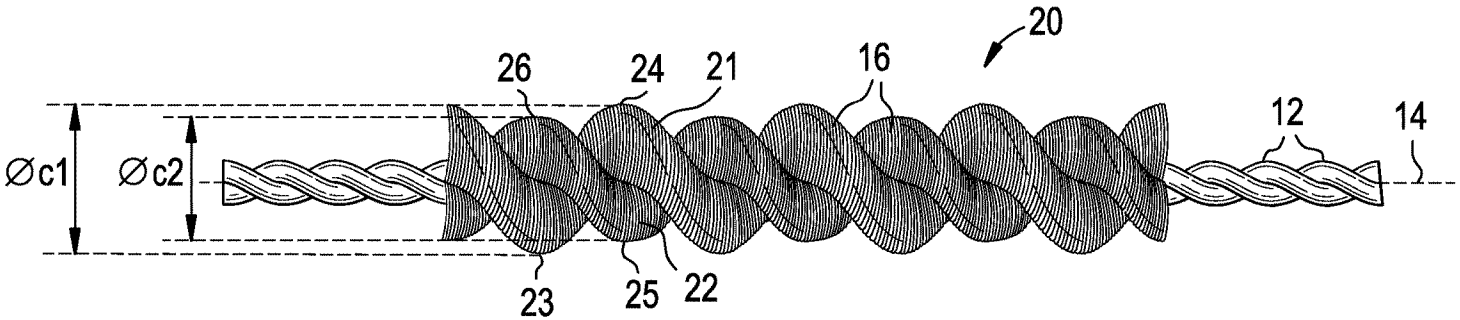
FIG. 2 illustrates a twisted wire brush, in accordance with an embodiment comprising spring coils having diameters that are different.

While the exemplary embodiment depicted in FIG. 1 illustrates each spring coil 16 having an approximately equal diameter, FIG. 2 illustrates a twisted wire brush 20 comprising spring coils 16 having diameters that are different. It is conceivable to use spring coils 16 with different diameters to produce a maximum twisted spring coil diameter $Ø_{c1}$ (e.g., in a side view such as FIG. 2, the diameter measured from a first peak 23 of a first spring coil 21 to a second peak 24 of the first spring coil 21, the second peak 24 being 180 degrees from the first peak 23), and a minimum twisted spring coil diameter $Ø_{c2}$ (e.g., in a side view such as FIG. 2, the diameter measured from a third peak 25 of a second spring coil 22 to a fourth peak 26 of the second spring coil 22, the fourth peak 26 being 180 degrees from the third peak 25). Varying the spring coil diameters thusly can be beneficial for certain purposes, or for cleaning certain non-flat surfaces. Further, the spring coil diameter of a single length of spring coil 16 can vary, either gradually or in discrete steps.

Referring again to FIG. 1, each length of spring coil 16 extends about a core wire 12 so the core wire 12 extends within the diameter of the respective spring coil 16 and through the respective spring coil 16. The core wires 12 can be longer than each length of spring coil 16. FIG. 1 illustrates two spring coils 16 being of approximately equal length, at about 5.5 inches. The length of each length of spring coil 16 can range indefinitely, however, limited only by manufacturing possibilities. Further, if the twisted wire brush 10 comprises multiple lengths of spring coils 16, the lengths of spring coils 16 need not be the same length. It is conceivable that utilizing lengths of spring coils 16 that are different lengths can be beneficial for certain applications.

Each length of spring coil 16 can comprise one or more spring coil segments. If a length of spring coil 16 comprises more than one spring coil segment, then each of the spring coil segments in the length of spring coil 16 can extend consecutively in a lengthwise direction of a core wire 12, the spring coil segments abutting end to end. Forming a length of spring coil 16 from a single spring coil 16 can reduce the possibility of defects, such as, but not limited to, gaps between consecutive spring coil segments extending in a lengthwise direction of a core wire 12 when no gaps are preferable, and free hanging ends of spring coil segments that catch on an object and bend out of shape. Forming a length of spring coil 16 from multiple spring coil segments, however, can reduce the cost of, and/or enable the production of twisted wire brushes 10 with relatively long core axes when relatively long spring coils 16 are unavailable or cost prohibitive. Forming a length of spring coil 16 from multiple spring coil segments can also facilitate varying the diameter along a single length of spring coil 16.

As illustrated in FIG. 1, there is an axial distance L between a first relative peak 17 in a first core wire 12 and second relative peak 18 in an adjacent core wire 12. The distance L is determined partly by how much (e.g., how tightly) the core wires are twisted. Decreasing the distance L increases the surface area of the twisted wire brush 10 that can contact a flat, planar surface. The distance L can be adjusted for certain applications. In a grill, for example, the peaks (and hence valleys) can be made to match the spacing between grill wires, so that the grill wires can fit into the valleys to clean beyond the top of the grill wires.

Rotating the twisted wire brush 10 about the core axis 14 can also increase the amount of contact over time between a surface area of a flat, planar surface and the twisted wire brush 10. The faster the rotation, the higher the rate new and abrasive contact occurs between the flat, planar surface and the twisted wire brush. An electrically-powered or battery-powered rotation mechanism (not shown) can be incorporated into the twisted wire brush 10 to drive the rotation.

The core axis 14 is illustrated as being straight in FIG. 1, but the core axis 14 can be bent into various shapes, as desired. For example, the core axis 14 can be bent 180 degrees one or more times to create one or more parallel sections of the core axis 14. For a linear motion of the twisted wire brush 10 in a direction perpendicular to the core axes, against a flat, planar surface, shaping the twisted wire cores in this fashion can also increase the surface area contacted by the spring coil peaks, particularly if the peaks are offset from one core axis to a parallel core axis.

Figure 3:
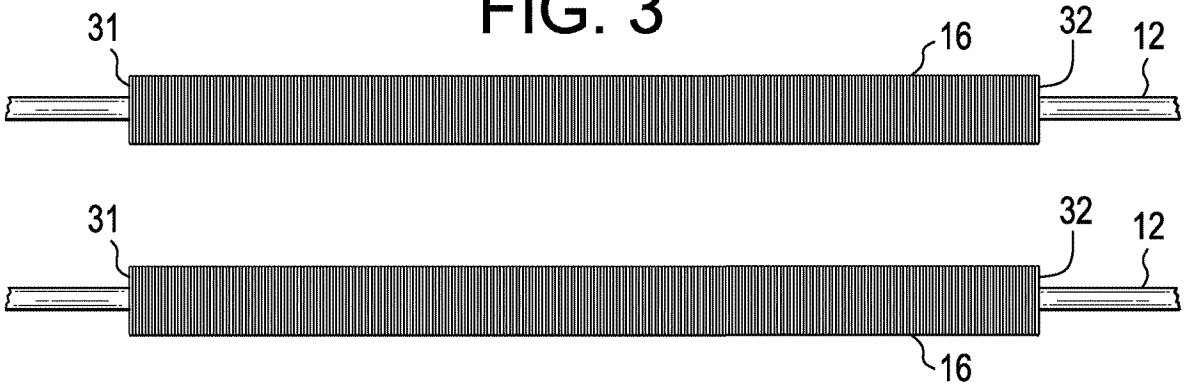
FIG. 3 illustrates a portion of a method of making the twisted wire brush illustrated in FIG. 1.
Figure 4:
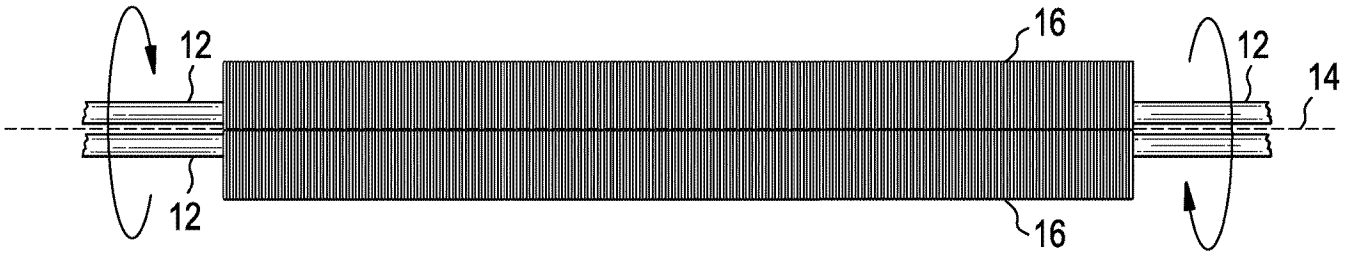
FIG. 4 illustrates a portion of a method of making the twisted wire brush illustrated in FIG. 1.

FIG. 3 and FIG. 4 illustrate a method of making the twisted wire brush illustrated in FIG. 1. At least two core wires 12 are provided and a length of spring coil 16 is positioned about at least one of the core wires 12 so that the at least one of the core wires 12 extends through one of the lengths of spring coil 16, beyond a first end 31 and a second end 32 of the spring coil 16. In the embodiment depicted in FIG. 3, a length of spring coil 16 is positioned about each of the core wires 12 so that each core wire 12 extends through one of the lengths of spring coil 16. As illustrated in FIG. 3, each length of spring coil 16 positioned about one core wire is aligned adjacent to another length of spring coil 16 positioned about another core wire. In FIG. 3, each first end 31 of each spring coil 16 is aligned and each second end 32 of each spring coil is aligned. In other embodiments, the first ends 31 can be offset with respect to each other, and/or the second ends 32 can be offset with respect to each other.

As illustrated in FIG. 4, the core wires 12 can be positioned together, spaced apart by as little as the sum of the diameters of the coil wire fabricating the spring coils 16. The core wires 12 can be intertwined by twisting the core wires 12 about the core axis 14. Twisting the core wires 12 presses the spring coils 16 between the adjacent core wires 12. The core wires 12 can be twisted until a predetermined value of torque or force is reached, or until the spring coils 16 are pressed between the core wires 12 with a predetermined value of force. The amount of force to press the spring coils 16 can be an amount of force sufficient to hold the spring coils 16 from moving axially with respect to the core wires 12, when a predetermined amount of force is applied axially against the spring coils 16, such as a maximum amount of force that might be applied during use of the twisted wire brush 10.

Figure 5:
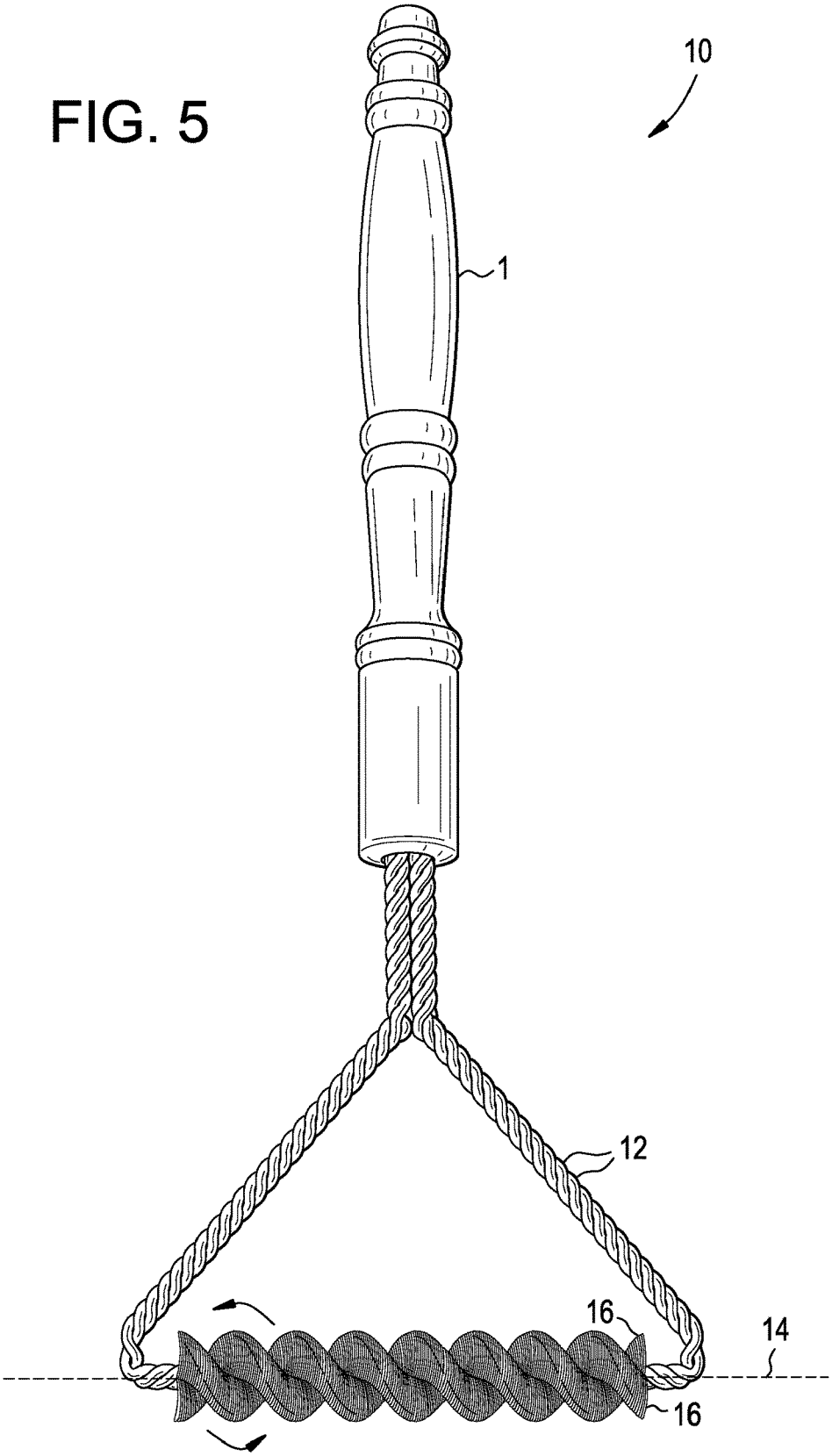
FIG. 5 illustrates an embodiment of a twisted wire brush comprising a handle.

FIG. 5 illustrates an embodiment of a twisted wire brush 10 comprising a handle 30. As illustrated in FIG. 5, the twisted core wires 12 extend out of the spring coils 16 and then bend toward and attach to the handle 30. In the embodiment illustrated in FIG. 5, each extension of the twisted core wires 12 from the spring coils 16 bends twice to form a section aligned perpendicularly with the core axis 14. The perpendicular section attaches to the handle so that the handle also aligns perpendicularly with the core axis 14. Each extension of the twisted core wires 12 can alternatively be bent in any desirable fashion and attached to a handle so that the handle is perpendicular, parallel, or oblique relative to the core axis 14.

While the present invention has been particularly shown and described with reference to the preferred mode as illustrated in the drawings, it will be understood by one skilled in the art that various changes in detail may be effected therein without departing from the spirit and scope of the invention as defined by the claims.

The invention claimed is:

1. A twisted wire brush comprising:

a twisted wire core having a first length, a core axis, and at least two core wires intertwined, the at least two core wires twisting helically about the core axis; and at least two lengths of spring coil, at least one length of each spring coil extending about each core wire, each length of spring coil being pressed between the core wires, wherein each spring coil comprises a plurality of consecutive 360 degree turns about a coil axis of each spring coil, and each length of spring coil is compressed axially such that at least a portion of each consecutive 360 degree turn around the coil axis of each springy coil abuts in an axial direction to an immediately preceding consecutive 360 degree turn.

2. A twisted wire brush as recited in claim 1, wherein each length of spring coil comprises multiple consecutive spring coils.

3. A twisted wire brush as recited in claim 1, wherein each length of spring coil comprises a single spring coil.

4. A twisted wire brush as recited in claim 1, wherein a first length of spring coil extending about a first core wire defines a first spring coil diameter, a second length of spring coil extending about a second core wire defines a second spring coil diameter, and the first spring coil diameter is different than the second spring coil diameter.

5. A twisted wire brush as recited in claim 1, wherein a first length of spring coil extending about a first core wire and a second length of spring coil extending about a second core wire have the same spring coil diameter.

6. A twisted wire brush as recited in claim 1, wherein at least one of the lengths of spring coil has a diameter that varies.

7. A method of making a twisted wire brush, the method comprising:

providing at least two core wires and at least two lengths of spring coil;

positioning a length of each spring coil about each core wire so that each core wire extends through the respective length of spring coil, each length of spring coil having a first end and a second end;

aligning each length of spring coil positioned about one of the core wires adjacent to another length of spring coil positioned about another of the core wires, so that each first end of each length of spring coil is aligned and each second end of each spring coil is aligned; and twisting each core wire about a core axis to form a helix, to intertwine the core wires, and to press the lengths of spring coil between adjacent core wires, wherein each spring coil comprises a plurality of consecutive 360 degree turns about a coil axis of each spring coil, and each length of spring coil is compressed axially such that at least a portion of each consecutive 360 degree turn around the coil axis of each spring coil abuts in an axial direction to an immediately preceding consecutive 360 degree turn.

8. A method of making a twisted wire brush as recited in claim 7, wherein the method further comprises twisting each core wire until a predetermined value of torque on the core wires is reached.

9. A method of making a twisted wire brush as recited in claim 7, wherein each length of spring coil comprises multiple consecutive spring coils.

10. A method of making a twisted wire brush as recited in claim 7, wherein each length of spring coil comprises a single spring coil.

11. A method of making a twisted wire brush as recited in claim 7, wherein a first length of spring coil defines a first spring coil diameter, a second length of spring coil defines a second spring coil diameter, and the first spring coil diameter is different than the second spring coil diameter.

12. A method of making a twisted wire brush as recited in claim 7, wherein a first length of spring coil and a second length of spring coil each define a single spring coil diameter.

13. A method of making a twisted wire brush as recited in claim 7, wherein at least one of the lengths of spring coil has a diameter that varies.

14. A twisted wire grill brush comprising:

a handle;

a plurality of twisted core wires attached to the handle, the plurality of core wires being intertwined and twisted about a core axis;

at least two lengths of spring coil, each length of spring coil respectively extending superimposed about each of at least two core wires, each length of spring coil being pressed between the twisted core wires, wherein each spring coil comprises a plurality of consecutive 360 degree turns about a coil axis of each spring coil, each length of spring coil is compressed axially such that at least a portion of each consecutive 360 degree turn around the coil axis of each spring coil abuts in an axial direction to an immediately preceding consecutive 360 degree turn, and the handle extends substantially perpendicularly to the at least two lengths of spring coil.

* * * * *